US006179168B1

(12) United States Patent
Desrosiers et al.

(10) Patent No.: US 6,179,168 B1
(45) Date of Patent: Jan. 30, 2001

(54) WATER HEATING SYSTEM FOR WATER DISPENSING FOUNTAINS

(75) Inventors: André Desrosiers; Michel Morand, both of Montreal (CA)

(73) Assignee: Addico Products Inc., Québec (CA)

( * ) Notice: Under 35 U.S.C. 154(b), the term of this patent shall be extended for 0 days.

(21) Appl. No.: 08/868,121

(22) Filed: Jun. 3, 1997

(51) Int. Cl.[7] ..... B67D 5/06

(52) U.S. Cl. ..... 222/185.1; 222/146.1; 392/441; 392/444

(58) Field of Search ..... 392/441, 443, 392/444, 445, 447; 165/58, 61, 64, 65, 66, 132, DIG. 342, DIG. 348, DIG. 351, DIG. 354; 137/337, 341; 62/389, 394; 222/146.1, 325, 185.1

(56) References Cited

U.S. PATENT DOCUMENTS

| | | | | |
|---|---|---|---|---|
| 1,190,289 | * | 7/1916 | Herz | 392/444 |
| 2,919,142 | * | 11/1959 | Schultz | 222/146.1 |
| 3,150,713 | * | 9/1964 | Loliger | 165/66 |
| 3,688,950 | * | 9/1972 | Parish | 222/146.1 |
| 3,698,603 | * | 10/1972 | Radcliffe | 222/146.1 |
| 4,792,059 | * | 12/1988 | Kerner et al. | 222/146.1 |
| 5,567,313 | * | 10/1996 | Almeida | 210/108 |

FOREIGN PATENT DOCUMENTS

| | | | | |
|---|---|---|---|---|
| 4316219-A1 | * | 11/1994 | (DE) | 392/441 |

* cited by examiner

*Primary Examiner*—Teresa J. Walberg
*Assistant Examiner*—Jiping Lu
(74) *Attorney, Agent, or Firm*—Swabey Ogilvy Renault; Guy J. Houle

(57) ABSTRACT

A water heater system for a water dispensing fountain having a refrigerated water reservoir, is disclosed. The water heater system is comprised of a plastic molded hot water tank formed in a support membrane. A feed conduit is also formed in the membrane and extends from a connector, which secures to the bottom wall of the refrigerated water reservoir, to the bottom end of a serpentine array of the conduit which extends upwardly to the bottom wall of the hot water tank. The purpose of the serpentine conduit is to prevent hot water from the tank from flowing back into the refrigerated water reservoir. A dispensing conduit extends from the hot water tank and is located at a position whereby water can be extracted from a valve connected thereto by gravity flow. An exhaust pipe also extends from the hot water tank and is provided with an exhaust port located above the top water level of the refrigerated water reservoir whereby to exhaust water pressure vapors from the hot water tank.

8 Claims, 2 Drawing Sheets

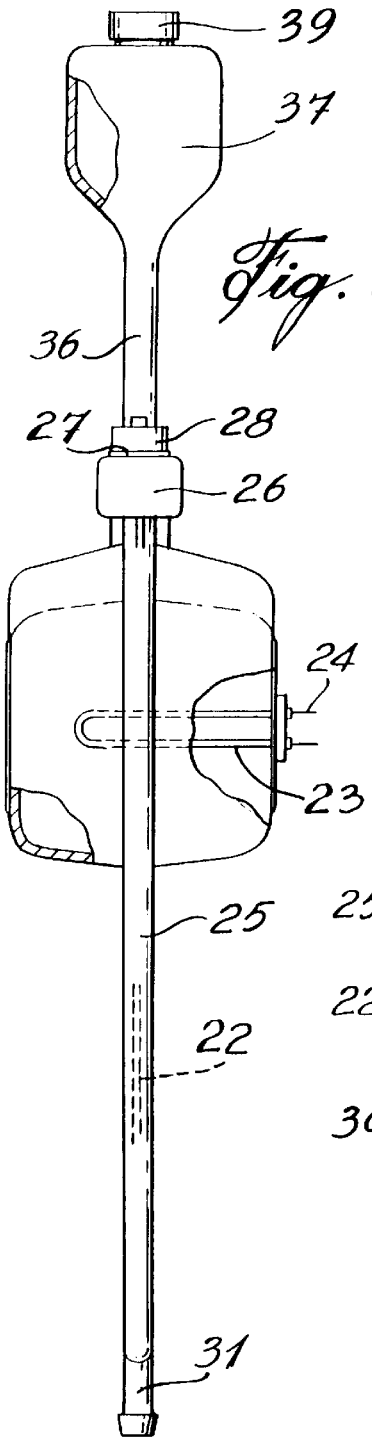
Fig. 3
Fig. 2
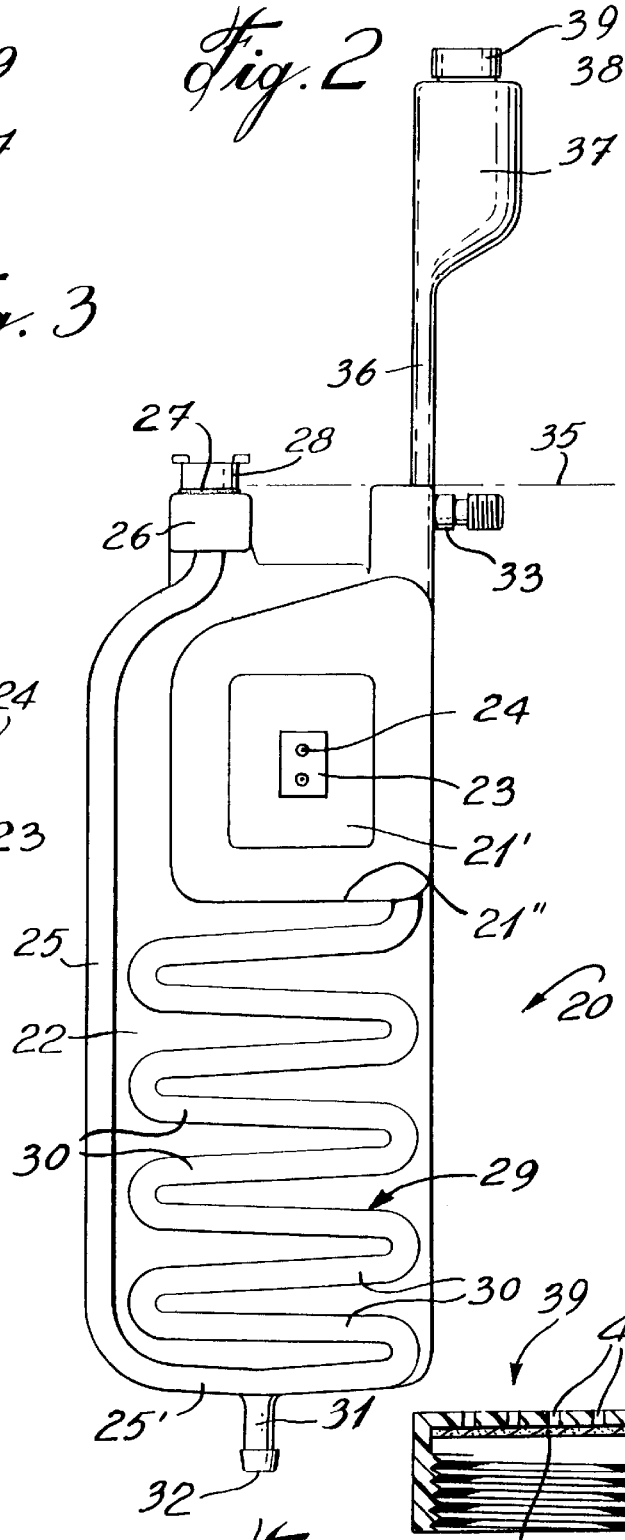
Fig. 4

WATER HEATING SYSTEM FOR WATER DISPENSING FOUNTAINS

TECHNICAL FIELD

The present invention relates to a water heater system which is mounted in a water fountain housing below the refrigerated water reservoir and connected thereto and further incorporating a buffer means to prevent hot water from the hot water tank from flowing back into the refrigerated reservoir. The hot water reservoir is a gravity fed reservoir.

BACKGROUND ART

It is known to heat water from water dispensing fountains so as to dispense both refrigerated water or water at room temperature as well as hot water for the preparation of tea or instant coffee. With gravity fed water heaters incorporating water heaters, it is a common problem that water vapours are released back in the refrigerated reservoir thereby raising the temperature of the refrigerated water. By doing so, the compressor is continuously switched on to maintain the refrigerated water at a desired temperature. Accordingly, this results in excess energy consumption. Another problem with existing systems is that they utilize metal tubes and metal water heaters. Accordingly, there are soldered joints in connecting these metal parts and this results in the formation of rust and corrosion and eventually water leaks develop. The rust also often affects the quality of the water which is consumed.

SUMMARY OF INVENTION

It is a feature of the present invention to provide a gravity fed water heater system which is formed of plastics material and which is provided with a buffer means to prevent water from the hot water reservoir to flow back into the refrigerated water reservoir.

Another feature of the present invention is to provide a gravity fed water heater system which is of modular construction and easy to install and service.

Another feature of the present invention is to provide a gravity fed water heater system which is of modular construction and which may be adapted to certain existing dispensing fountains of the type having refrigerated water reservoirs.

According to the above features, from a broad aspect, the present invention provides a gravity fed water heater system for a water dispensing fountain having a refrigerated water reservoir. The water heater system comprises a hot water tank having a resistive heating element therein. Feed conduit means is provided and has a connecting end for securement to the refrigerated reservoir and for feeding water to the hot water tank. Buffer means is associated with the feed conduit means to prevent hot water from the hot water tank from flowing back and mixing with cold water in the refrigerated reservoir. Exhaust means is also associated with the hot water tank as well as dispensing means to dispense hot water from the tank. Means is provided to secure the hot water tank below the refrigerated reservoir of the water dispensing fountain.

BRIEF DESCRIPTION OF DRAWINGS

A preferred embodiment of the present invention will now be described with reference to the accompanying drawings in which:

FIG. 2 is a side view of the gravity fed water heater system of the present invention;

FIG. 3 is a side end view of FIG. 2;

FIG. 4 is a section view showing the construction of the cap secured to the exhaust port of the condensate chamber.

DESCRIPTION OF PREFERRED EMBODIMENTS

Figure 1:
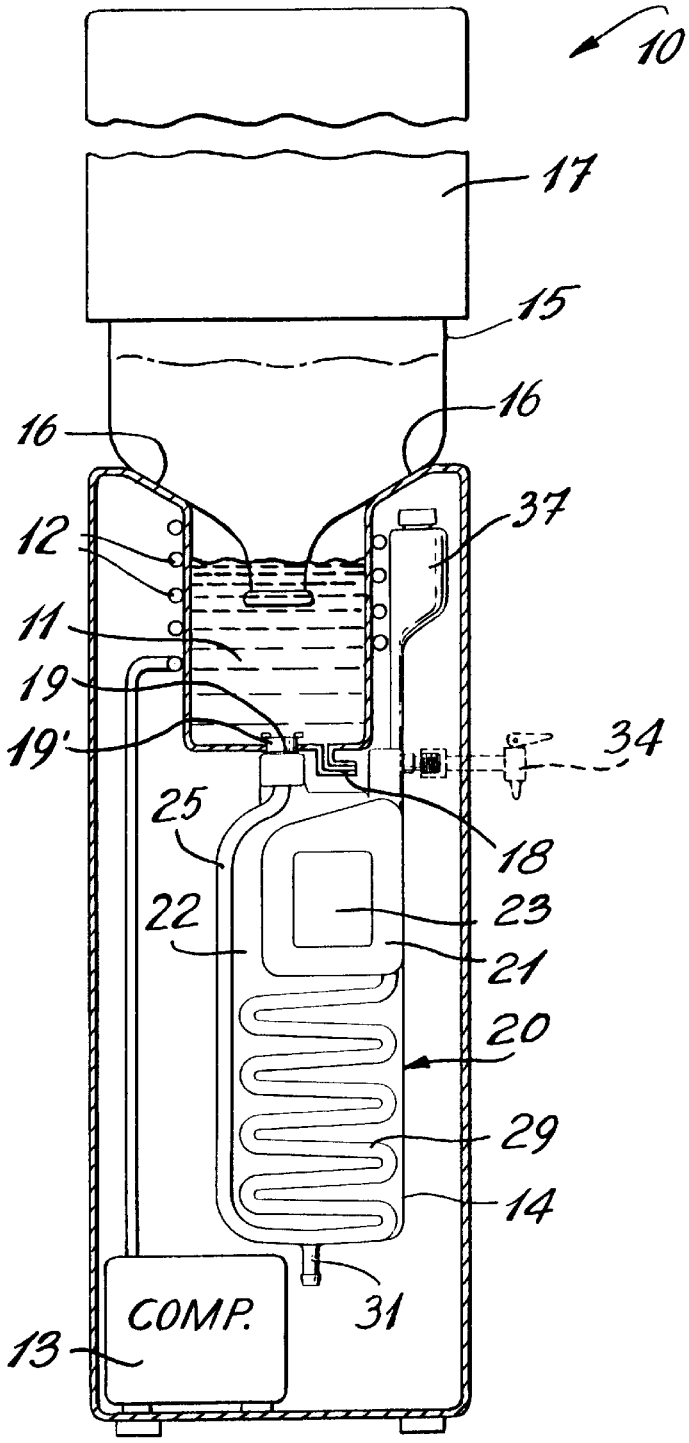
FIG. 1 is a section view through a water dispensing fountain to which the gravity fed water heater system of the present invention has been incorporated.

Referring to the drawings and more particularly to FIG. 1, there is shown generally at 10 a water dispensing fountain as is well known in the art and incorporating therein a refrigerated water reservoir 11 having a refrigerating coil 12 wound thereabout and fed by a compressor 13 which is usually located at the base of the housing 14. A 5 gallon water bottle 15 usually sits on top of the refrigerated water reservoir 11 and supported in an inverted position, as hereinshown, on a circumferential shoulder 16 formed about the upper end of the refrigerated water reservoir 11. A cover 17 is slidably positionable over the water bottle 15 to conceal same and abuts about the shoulder 16. A water conduit 18 is connected to the bottom wall 19 of the refrigerated reservoir 11 to dispense cold water through a valve not shown, but well known in the art.

The present invention is concerned with a gravity fed water heater system 20 as hereinshown attached under the refrigerated water reservoir 11. With further reference to FIG. 2, it can be seen that the water heater system 20 is an integrated modular system formed of plastics material and capable of withstanding heat generated by a hot water tank 21 molded integrally with a flat support membrane 22. A resistive heating element 23 is secured to a side wall 21' of the hot water tank 21 and is provided with connections 24 to connect same to the electrical supply whereby water within the hot water tank will be heated.

The hot water tank 21 is fed water from the refrigerated water reservoir 11 by gravity through a feed pipe 25 molded in the membrane 22. The feed pipe 25 extends from a connector 26 which is provided with a seal 27 and a connecting nut 28 whereby to attach same, in a leak-proof fashion, about a hole 19' in the bottom wall 19 of the refrigerated reservoir. The bottom end 25' of the feed conduit 25 extends to a serpentine conduit section 29 which extends to the bottom wall 21" of the hot water tank 21 and communicates therewith. The serpentine section 29 is constituted by interconnected downwardly sloped alternating straight conduit sections 30 extending downwardly from the bottom wall 21" of the hot water tank 21 and merging with the bottom end section 25' of the feed conduit 25. The purpose of the serpentine conduit section 29 is to provide a buffer between the hot water tank 21 and the refrigerated reservoir 11 whereby hot water from the hot water tank will not flow back into the refrigerated water reservoir but will be arrested by the serpentine conduit section 29.

A drain port 31 having a closure cap 32 is integrally formed with the bottom section 25' of the feed conduit to drain the hot water system including the refrigerated reservoir 11 through the hole 19' provided in the bottom wall and to which the connector 26 is secured. If the water heater system 20 is secured to an existing water dispensing fountain, it is necessary to drill a port hole such as 19' in the bottom wall 19 to connect the hot water heater system 20. Accordingly, the connector 26 as well as the dispensing conduit 33 which is secured through a hole formed in the wall of the housing 14 and to which a dispensing valve 34 (see FIG. 1) is connected constitutes a means to secure the hot water heater system 20 to the water dispensing fountain.

As shown in FIG. 2, the dispensing conduit 33 is located below the plane 35 of the bottom wall 19 of the refrigerated water reservoir 11 whereby the water from the reservoir 11 will flow by gravity through the feed conduit 25, up the serpentine conduit section 29 and into the hot water tank 21 where the water is heated.

An exhaust means in the form of a vertical conduit 36 having a condensate chamber 37 with an exhaust port 38 in a top wall thereof is also provided whereby vapour generated from the hot water tank 21 will condensate into the housing 37 and remain within the tank 21. With additional reference to FIG. 4, there is shown a plastic perforated cap 39 secured over the exhaust port 38 to release pressure due to the hot water vapours and to prevent pressure build up in the condensate chamber 37. A filter disc 40 is retained within the cap 39 against the holes 41 provided in the top wall of the cap. The cap 39 is removably securable to the condensate chamber and is in threaded engagement about the port 38.

It is pointed out that the integrated modular system does not occupy much space within the water fountain housing 14 and is dimensioned to adapt inside free space provided in such water fountains. For example, the exhaust conduit 36 and condensate chamber 37 sit in the space adjacent the refrigerator reservoir 11 and the exhaust port 38 is located above the top water level of the refrigerated reservoir 11 whereby to maintain the water level in the condensate housing at a level sufficiently below the exhaust port 38 taking into consideration the fact that the water therein is hot and that pressure is continuously released.

Automatic controls regulate the temperature of the hot water in a manner well known in the art. It can also be appreciated that with the modular construction of the water heater system 20, it is easy to fit the system to existing water fountains or new water fountain constructions and it is also easy to replace the system should this be required.

It is within the ambit of the present invention to cover any obvious modifications of the preferred embodiment described herein provided such modifications fall within the scope of the appended claims.

We claim:

1. A gravity fed water heater system for a water dispensing fountain having a refrigerated water reservoir, said water heater system comprising a hot water tank having a resistive heating element therein, feed conduit means having a connecting end for securement to said refrigerated reservoir and for feeding water to said hot water tank, buffer means associated with said feed conduit means to prevent hot water from said hot water tank from flowing back and mixing with cold water in said refrigerated reservoir, exhaust means in communication with said hot water tank to prevent vapour from said hot water tank to be channeled to said refrigerated water reservoir, a hot water conduit to dispense hot water from said hot water tank, said hot water conduit communicating with said hot water tank, a hot water dispensing valve connected to said hot water conduit and disposed below said refrigerated reservoir, and means to secure said hot water tank below said refrigerated reservoir.

2. A water heater system as claimed in claim 1 wherein said buffer means is constituted by a serpentine conduit section of said feed conduit means and located below said hot water tank.

3. A water heater system as claimed in claim 2 wherein said serpentine conduit section is formed of interconnected downwardly sloped alternating straight conduit sections extending downwardly from a bottom wall of said hot water tank and merging at a bottom end thereof into a conduit which projects upwardly and above said hot water tank to connect with a water dispensing port in a bottom wall of said refrigerated reservoir.

4. A water heater system as claimed in claim 2 wherein said water heater system is an integrated modular system formed of plastics material capable of withstanding heat generated by said hot water tank.

5. A water heater system as claimed in claim 4 wherein said means to secure said hot water tank below said refrigerated reservoir is constituted by said connecting end of said feed conduit means being connected to a water dispensing port formed in a bottom wall of said refrigerated reservoir and said dispensing means which is a hot water conduit adapted to be connected to a sidewall of a water dispensing fountain.

6. A water heater system as claimed in claim 4 wherein said modular system comprises a support membrane in which is integrally formed said hot water tank, said feed conduit means, said buffer means and said exhaust means.

7. A water heater system as claimed in claim 1 wherein said exhaust means is comprised of a condensing housing having a condensate chamber connected to said hot water conduit and extending above said hot water conduit, and an exhaust port in said condensing housing through which water vapours can exit.

8. A water heater system as claimed in claim 4 wherein said exhaust port is a threaded port formed in a top wall of said condensing housing, and a threaded perforated cap having a filter disc therein and in threaded engagement with said threaded port.

* * * * *